US012031426B2

(12) United States Patent
Hondred et al.

(10) Patent No.: US 12,031,426 B2
(45) Date of Patent: Jul. 9, 2024

(54) ESP MONITORING SYSTEM AND METHODOLOGY

(71) Applicant: Schlumberger Technology Corporation, Sugar Land, TX (US)

(72) Inventors: Peter Hondred, De Soto, KS (US); Jason Holzmueller, Lawrence, KS (US); Alejandro Camacho Cardenas, Singapore (SG); Johan Lindal Haug, Kristiansand (NO); Geir Kroslid, Kristiansand (NO); Jinglei Xiang, Rancho Cucamonga, CA (US); Gregory Howard Manke, Overland Park, KS (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 358 days.

(21) Appl. No.: 17/417,845

(22) PCT Filed: Dec. 19, 2019

(86) PCT No.: PCT/US2019/067553

§ 371 (c)(1),
(2) Date: Jun. 24, 2021

(87) PCT Pub. No.: WO2020/139709

PCT Pub. Date: Jul. 2, 2020

(65) Prior Publication Data

US 2022/0082009 A1 Mar. 17, 2022

Related U.S. Application Data

(60) Provisional application No. 62/784,668, filed on Dec. 24, 2018.

(51) Int. Cl.
*E21B 47/008* (2012.01)
*E21B 47/11* (2012.01)
(Continued)

(52) U.S. Cl.
CPC ..... *E21B 47/008* (2020.05); *E21B 47/11* (2020.05); *E21B 47/135* (2020.05); *F04D 13/10* (2013.01); *F04D 15/0088* (2013.01)

(58) Field of Classification Search
CPC ..... E21B 47/008; E21B 47/11; E21B 47/111; E21B 47/135; F04D 13/10; F04D 15/0088
See application file for complete search history.

(56) References Cited

U.S. PATENT DOCUMENTS 7,510,011 B2 * 3/2009 Le Gloahec ..... E21B 43/084 166/228
2003/0134426 A1 * 7/2003 Jiang ..... E21B 49/081 436/28

(Continued)

FOREIGN PATENT DOCUMENTS

WO 2015026919 A1 2/2015
WO 2015026924 A1 2/2015
WO 2017023320 A1 2/2017

OTHER PUBLICATIONS

Janzen, et al. Colorimetric Sensor Arrays for Volatile Organic Compounds, Anal. Chem, May 3, 2006 vol. 78, Issue 11, pp. 3591-3600.

(Continued)

*Primary Examiner* — Shane Bomar
(74) *Attorney, Agent, or Firm* — Philippe Laguerre

(57) ABSTRACT

A technique is provided to facilitate monitoring of contaminants which can potentially enter an electric submersible pumping system. A sensor system is used in conjunction with the electric submersible pumping system to detect the (Continued)

presence of specific contaminants which can affect future operation of the electric submersible pumping system. Depending on the embodiment, the sensor system may comprise a sensor or sensors disposed within the electric submersible pumping system and/or in or along components associated with the electric submersible pumping system. Each sensor is used to monitor for the contaminant and to provide data to a control system so as to facilitate decision-making regarding future operation of the electric submersible pumping system.

14 Claims, 8 Drawing Sheets

(51) Int. Cl.

| | |
|---|---|
| ***E21B 47/135*** | (2012.01) |
| ***F04D 13/10*** | (2006.01) |
| ***F04D 15/00*** | (2006.01) |

(56) References Cited

U.S. PATENT DOCUMENTS

| | | | | |
|---|---|---|---|---|
| 2007/0051510 | A1 | 3/2007 | Veneruso et al. | |
| 2007/0142547 | A1* | 6/2007 | Vaidya | E21B 33/1208 252/511 |
| 2007/0199696 | A1* | 8/2007 | Walford | E21B 43/2406 166/50 |
| 2008/0262735 | A1 | 10/2008 | Thigpen et al. | |
| 2012/0179378 | A1 | 7/2012 | Duncan et al. | |
| 2013/0277047 | A1* | 10/2013 | Kuhn de Chizelle | E21B 17/203 166/305.1 |
| 2014/0099211 | A1 | 4/2014 | Sheth et al. | |
| 2018/0163728 | A1* | 6/2018 | Zugelder | E21B 43/12 |
| 2018/0291910 | A1* | 10/2018 | Mills | F04D 13/10 |
| 2018/0347346 | A1 | 12/2018 | Gouda et al. | |
| 2019/0003476 | A1* | 1/2019 | Jee | F04B 53/18 |
| 2019/0164670 | A1* | 5/2019 | Holzmueller | H01B 7/046 |
| 2021/0372243 | A1* | 12/2021 | Arukhe | F04B 17/03 |

OTHER PUBLICATIONS

International Search Report and written opinion issued in PCT Application PCT/US2019/067553, dated Apr. 21, 2021 (16 pages).

M. Moraes et al. Development of Fast Response Humidity Sensors Based on Carbon Nanotubes. Sensor Devices 2014, (4 pages).

Q.Y. Tang et al. Fast-response Polyimide/multiwall carbon nanotube composite films for monitoring humidity in Microelectronic packages. 12th Electronics Packaging Technology Conference, 2010. (4 pages).

J.W. Han et al. Carbon nanotube based humidity sensor on cellulose paper, J. Phys.Chem.C 2012, 116, 22094-22097.

* cited by examiner

ESP MONITORING SYSTEM AND METHODOLOGY

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application is a National Stage of International Application No. PCT/US2019/067553, filed Dec. 19, 2019, which claims priority benefit of U.S. Provisional Application No. 62/784,668, filed Dec. 24, 2018, the entirety of each of which is incorporated by reference herein and should be considered part of this specification.

BACKGROUND

Electric submersible pumping systems are deployed downhole and may be operated to pump oil and/or other fluids to the surface for collection when the natural drive energy of the reservoir is not strong enough to lift the well fluids to the surface. An electric submersible pumping system comprises a submersible centrifugal pump powered by a separate submersible electric motor. The submersible electric motor is protected by a motor protector, which is sometimes referred to as a seal section, to prevent entry of well fluid into the submersible pumping system. However, the motor protector as well as other components of the electric submersible pumping system utilize shaft seals which can leak over time and allow detrimental well fluid to enter the submersible pumping system.

Sensor systems have been employed to monitor operation of the electric submersible pumping system. However, current sensor equipment is limited to physical measurement of system properties, such as temperature, power, speed, and vibration. These parameters can provide good information on how the submersible pumping system is operating at a given point in time but they do not provide a direct indication as to how the submersible pumping system will tend to operate in the future, thus making prognostic health management very difficult. For example, current sensor systems do not adequately detect the migration of well fluid contaminants into the motor protector, submersible motor, and/or other pumping system components but such well fluid contaminants can have a large impact on future operation of the pumping system.

SUMMARY

In general, the present disclosure provides a system and methodology for monitoring contaminants which can potentially enter an electric submersible pumping system. A sensor system is used in conjunction with the electric submersible pumping system to detect the presence of specific contaminants which can affect future operation of the electric submersible pumping system. Depending on the embodiment, the sensor system may comprise a sensor or sensors disposed within the electric submersible pumping system and/or in or along components associated with the electric submersible pumping system. Each sensor is used to monitor for presence of the contaminant and to provide data to a control system so as to facilitate decision-making regarding future operation of the electric submersible pumping system.

BRIEF DESCRIPTION OF THE FIGURES

Certain embodiments of the disclosure will hereafter be described with reference to the accompanying drawings, wherein like reference numerals denote like elements. It is emphasized that, in accordance with standard practice in the industry, various features are not drawn to scale. In fact, the dimensions of various features may be arbitrarily increased or reduced for clarity of discussion. It should be understood, however, that the accompanying figures illustrate the various implementations described herein and are not meant to limit the scope of various technologies described herein, and.

DETAILED DESCRIPTION

Figure 1:
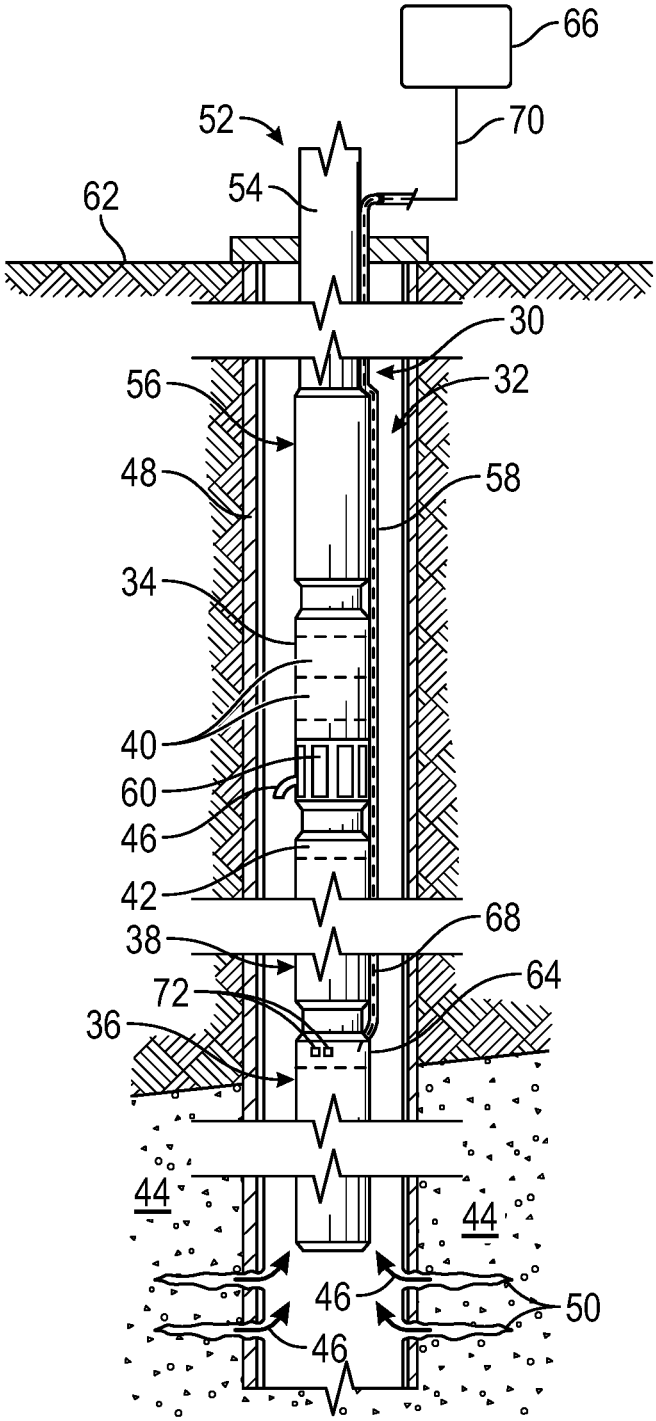
FIG. 1 is an illustration of an example of an electric submersible pumping (ESP) installation combined with a sensor system, according to an embodiment of the disclosure.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

Electric submersible pumping systems may be used in a variety of demanding applications in extreme environments. Components of an electric submersible pumping system may comprise polymeric materials and/or other materials which may be susceptible to relatively small amounts of contamination. These relatively small amounts of contamination can lead to catastrophic issues with respect to submersible motors and/or other components of the electric submersible pumping system. Examples of potentially hazardous chemical contaminants include $H_2S$, $H_2O$, $CO_2$, well treatment chemicals, and various other chemicals which may be present downhole in, for example, well fluid.

In general, the system and methodology described herein facilitate monitoring of an electric submersible pumping system, e.g. a submersible motor, in a manner which facilitates protection against component failure. For example, the ability to monitor and protect helps an operator plan for a work over or other activity to mitigate the potential for failure. According to an embodiment, a sensor system is used in conjunction with the electric submersible pumping system to detect the presence of specific contaminants which can affect future operation of the electric submersible pumping system. The sensor system may comprise a sensor or sensors disposed within the electric submersible pumping system and/or in or along components associated with the electric submersible pumping system. Each sensor is used to monitor for the contaminant and to provide data to a control system so as to facilitate decision-making regarding future operation of the electric submersible pumping system.

In some embodiments, the sensor system may utilize various markers which may be introduced into the well fluid environment to help corresponding sensors detect the presence of contaminants. Some applications may utilize optical sensors having fluorescence and/or colorimetric sensor technology for monitoring chemical contamination in a pumping system component, such as the submersible motor. In this latter example, the monitoring utilizes color changes and fluorescing media that change when contact with specific chemicals occurs. By monitoring the changes via the sensors, quantifiable data can be extracted for understanding the changes with respect to the submersible pumping system environment. Such sensors may be placed in and/or around the submersible motor (or other pumping system components). An optical fiber, e.g. a fiber optic cable, may be used to transfer the signal/data back to a surface controller. By way of example, a small fiber-optic cable may be embedded into a power cable used to provide electrical power to the electric submersible pumping system.

Referring generally to FIG. 1, an example of an electrical submersible pump (ESP) system 30 is illustrated as deployed in a borehole 32, e.g. a wellbore. Submersible pumping system 30 may comprise a variety of components depending on the particular application or environment in which it is used. The illustrated pumping system 30 includes a submersible pump 34 coupled to a submersible electric motor 36 and a motor protector 38. The motor protector 38 is used to prevent early well fluid entry into the submersible motor 36. The motor protector 38 may have a redundancy of chambers and/or other features, e.g. compensators and shaft seals, to help prevent entry of well fluid. As described in greater detail below, a sensor system may be used to detect whether well fluid is entering via the seals or other pumping system features. In some embodiments, well fluid entry progression can be tracked to enable improved planning with respect to servicing or replacement of the submersible pumping system 30.

Referring again to FIG. 1, the submersible pump 34 may include two or more stages 40 having impellers, e.g. compression stages in the form of radial flow, mixed flow, or axial flow stages. However, other types of submersible pumps 34 may be used for pumping well fluid. The net thrust load, e.g. downthrust load, resulting from rotation of the impellers may be resisted by a bearing 42 located in motor protector 38.

In the illustrated embodiment, wellbore 32 is drilled into a geological formation 44 containing a desirable production fluid 46, such as petroleum. Wellbore 32 may be lined with a tubular casing 48 and perforations 50 may be formed through wellbore casing 48 to enable flow of fluids between the surrounding formation 44 into the wellbore 32. Submersible pumping system 30 is deployed in wellbore 32 by a deployment system 52 that may have a variety of configurations. For example, deployment system 52 may comprise tubing 54, such as coiled tubing or production tubing, connected to submersible pump 34 by a connector 56. Power may be provided to the submersible motor 36 via a power cable 58. The submersible motor 36, in turn, powers submersible pump 34 which can be used to draw in production fluid 46 through a pump intake 60. During operation of submersible pump 34, the fluid 46 is pumped/produced through, for example, tubing 54 to a desired collection location which may be at a surface 62 of the Earth.

According to the embodiment illustrated, a sensor system 64 is used to monitor entry of undesirable constituents into electric submersible pumping system 30. Examples of undesirable constituents may include $H_2S$, $H_2O$, $CO_2$, well treatment chemicals, petroleum, and various other chemicals which may be present in well fluid or in other fluids used downhole. The sensor system 64 may comprise a variety of individual or combined sensors located in submersible motor 36 and/or other components of electric submersible pumping system 30.

By way of example, data acquired via sensor system 64 may be delivered to a control system 66, e.g. a processor-based system, located at surface 62 or other suitable locations. The data acquired via sensor system 64 may be sent uphole along a communication line 68 which in some applications comprises an optical fiber. According to an embodiment, communication line 68 may be in the form of a fiber optic cable 70 disposed within power cable 58. However, other types of wired or wireless communication lines 68 may be used and such other types of communication lines may be routed along power cable 58 or along other suitable routes.

In some embodiments, sensor system 64 may be constructed to perform chemical analysis of the motor oil used within submersible motor 36 and motor protector 38. The sensor system 64 may include a sensor or sensors 72 which are able to detect the presence of certain chemicals. By way of example, the sensors 72 may be in the form of fluorescence and/or colorimetric sensors able to monitor for chemical contamination of the motor oil. Such fluorescence/colorimetric sensors 72 may be used to identify the presence of $H_2S$, $H_2O$, $CO_2$, well fluids or other constituents.

Individual sensors 72 may be selected to monitor for specific chemicals to enable collective monitoring for the presence of a variety of constituents. With fluorescence and/or colorimetric sensors 72, a change in color or glow is detected depending on the choice of a fluorescence sensor or a colorimetric sensor. The intensity of the signal corresponds to the amount of contamination in the system, e.g. in the motor oil. The fiber optic cable 70 (or other suitable communication line 68) may be used to transmit the signals and corresponding data from the sensor system 64 to the processing system 66.

By way of example, the sensors 72 may be located in and around the submersible motor 36 and monitoring may be performed over time to determine contamination and whether such contamination increases in the submersible motor 36. It should be noted the sensors 72 may be employed in other components of the submersible pumping system 30, however monitoring of the motor oil within submersible motor 36 and/or motor protector 38 can be very useful in a variety of applications. For example, seals used in the submersible motor 36 can fail for multiple reasons, such as contamination, dielectric loss, bearing failure, chemical attack, and other events. If not detected, the contamination can be catastrophic due to a slow ingression of the contaminant into the motor oil over time. By monitoring for contamination in the motor oil, better predictions with respect to motor failure can be developed to enable better response times and better overall downtime management during servicing or replacement of the electric submersible pumping system 30.

In some applications, the sensor system 64 may utilize markers which may be detected by sensor 72. For example, markers may be added to well fluids and/or dielectric oil in the submersible pumping system 30. Sensors 72 located within submersible motor 36 and/or other components of the submersible pumping system 30 can be used to monitor for the presence of or changes in the marker material so as to determine contamination. For example, the sensor 72 may be used to detect markers located in well fluid so as to enable tracking of well fluid entry into submersible pumping system 30 as well as well fluid entry progression. Marker material also can be a pre-existing substance in the well fluids that can be exploited for detection of well fluids entry into the pumping system.

Figure 2:
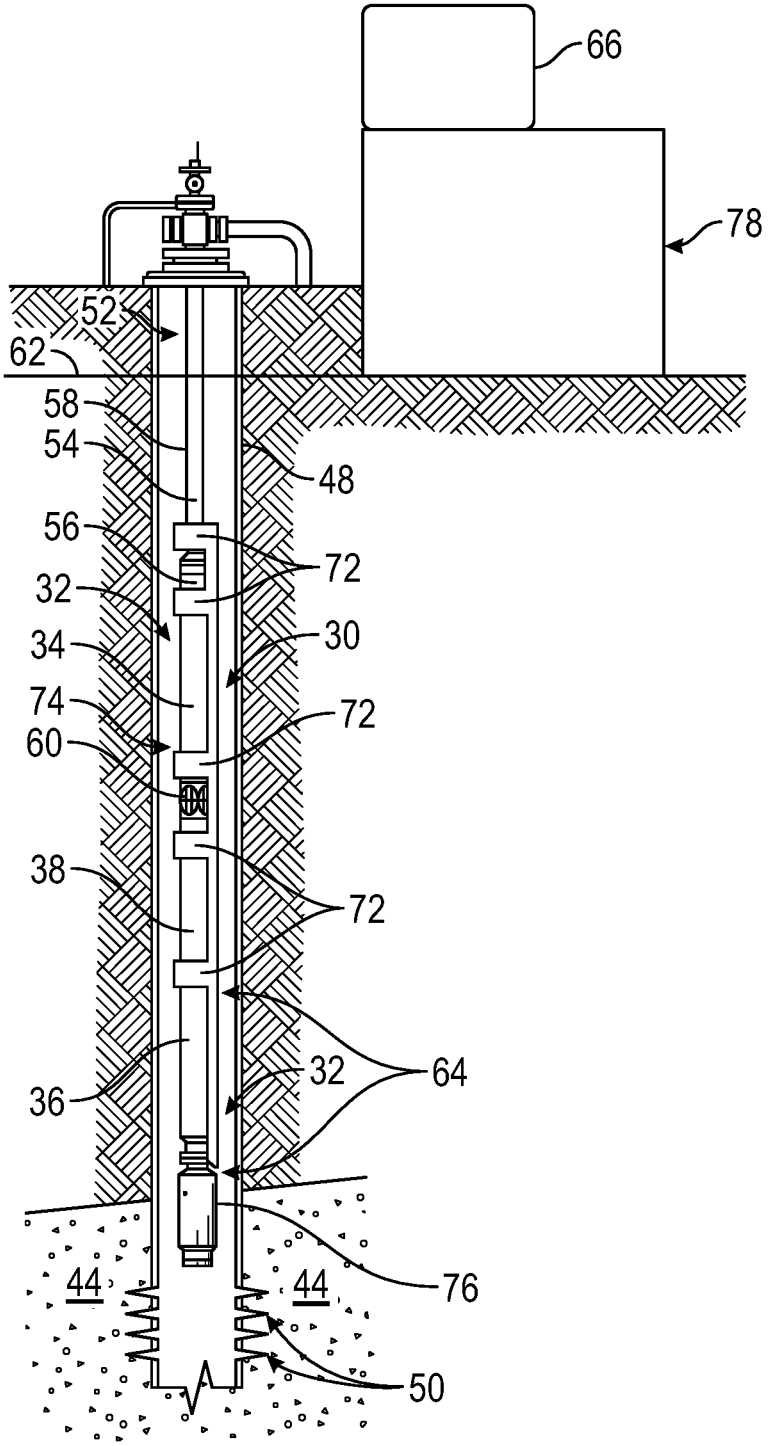
FIG. 2 is an illustration of an example of an ESP system with a sensor system having a base gauge and remote sensors, according to an embodiment of the disclosure.

Referring generally to FIG. 2, another embodiment of electric submersible pumping system 30 is illustrated. In this example, the submersible pumping system 30 is deployed along an ESP string 74 and comprises submersible pump 34, pump intake 60, motor protector 38, electric submersible motor 36, and sensor system 64 which includes a base gauge 76. Submersible motor 36 is in electric communication with, and receives electric power from, a surface drive 78 or other suitable power source via power cable 58. In some embodiments, the communication line 68 may be routed within the power cable 58 for communication with control system 66, e.g. a computer-based control system.

In this example, the sensor system 64 comprises sensors 72 disposed along the ESP string 74, including within the base gauge 76. The sensors 72 comprise constituent sensors, but also may comprise other types of sensors for detecting additional parameters, such as pressure, temperature, and/or vibration.

By way of example, the base gauge 76 may be located at the lower end of electric submersible pumping system 30. Base gauge 76 may be bolted via a flange connection to the base of electric motor 36. Additionally, base gauge 76 may receive power and may communicate with surface equipment via a connection to the wye-point of submersible motor 36 or via other power and data communication techniques.

Figure 3:
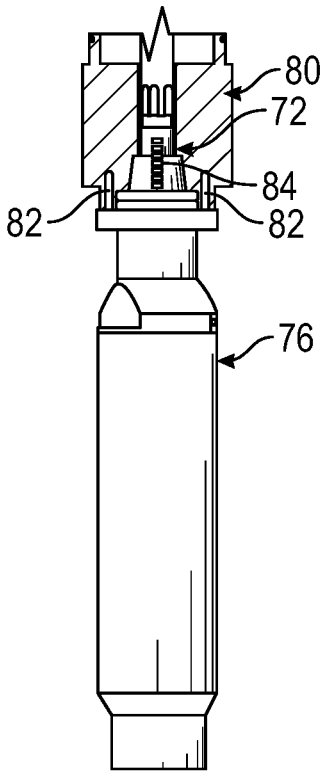
FIG. 3 is an illustration of an example of the base gauge, according to an embodiment of the disclosure.

With additional reference to FIG. 3, an embodiment of base gauge 76 is illustrated. In this example, base gauge 76 may be affixed to a motor base 80 of submersible motor 36 by one or more fasteners 82. Fasteners 82 may include screws, bolts, rivets or other suitable fasteners.

Figure 4:
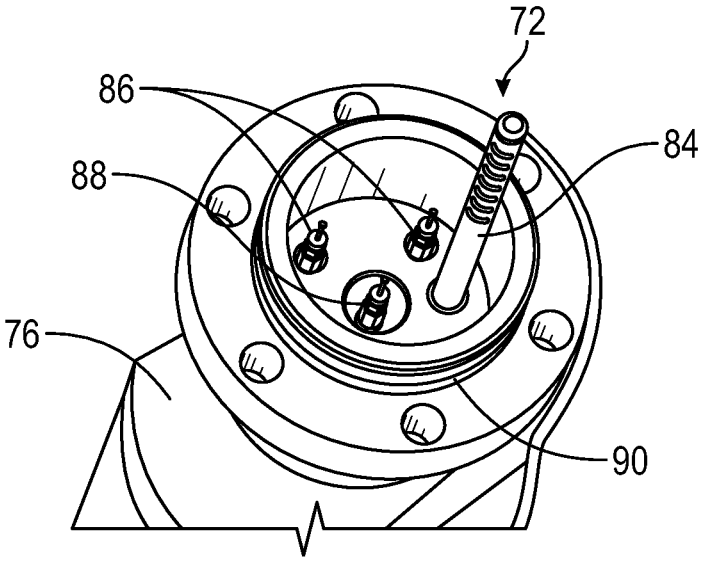
FIG. 4 is an illustration of an example a sensor disposed in the electric submersible pumping system to monitor a motor oil condition, according to an embodiment of the disclosure.

The sensor system 64 comprises at least one sensor 72 located within base gauge 76. The at least one sensor 72 may be in the form of an oil condition sensing probe 84 which extends upwardly from base gauge 76 into motor base 80 such that the sensor 72/probe 84 is immersed in, and in contact with, motor oil contained in electric submersible motor 36. In some embodiments, the base gauge 76 may comprise a variety of other features, such as a thermocouple connector 86 and a motor wye-point connection 88 as illustrated in FIG. 4. A sealing element or a plurality of sealing elements 90 may be disposed on an exterior surface of the upper end of base gauge 76 to form a seal against an interior surface of motor base 80 when assembled thereto.

It should be noted that base gauge 76 is one type of mechanism for deploying a corresponding sensor 72 in contact with internal motor oil. However, the sensor or sensors 72 may be positioned at other locations adjacent to or within submersible motor 36 and/or other components of submersible pumping system 30. Additionally, the sensing probe 84/sensor 72 may have many types of configurations.

As discussed above, one or more of the sensors 72 may be in the form of fluorescence and/or colorimetric sensors able to monitor for chemical contamination of the motor oil. By way of example, such fluorescence/colorimetric sensors 72/probes 84 may be used to identify the presence of $H_2S$, $H_2O$, $CO_2$, well fluids or other constituents entering submersible motor 36 or other pumping system components. In some embodiments, for example, the probe 84 and/or other sensor 72 may be in the form of a colorimetric sensor which uses a colorimetric sensor array as illustrated in FIG. 5.

Figure 5:
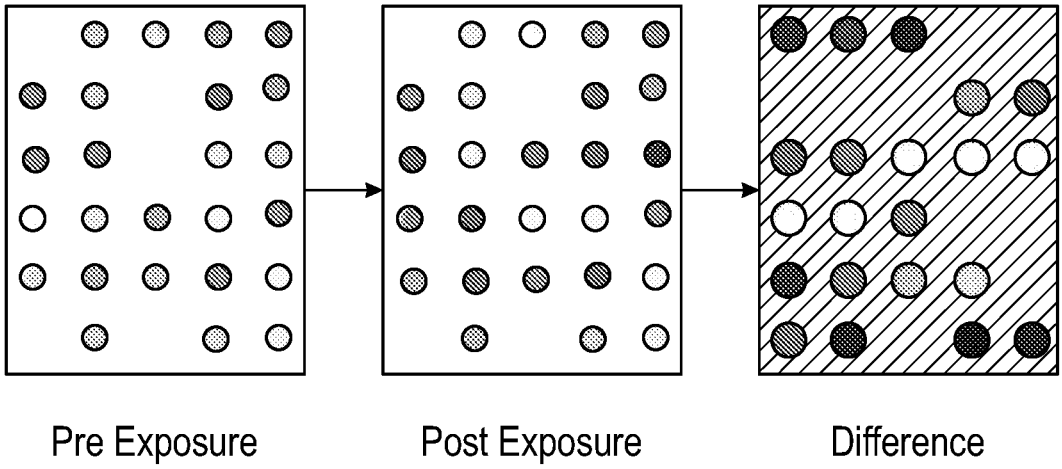
FIG. 5 is an illustration showing how a colorimetric and/or fluorescent sensor array may be used to monitor for contaminants in the electric submersible pumping system, according to an embodiment of the disclosure.

With this type of sensor 72, a colorimetric array has a given pattern of colors and/or brightness prior to exposure to a contaminating material (see left image in FIG. 5). Once the sensor 72 is exposed to the chemical contaminant of interest, the colorimetric array changes as indicated by the middle image in FIG. 5. The differences in the array from before exposure to after exposure can be assembled in a difference map (see right image in FIG. 5). The difference map may be created via control system 66 or via downhole processing of the data. The colorimetric array data may be sent uphole via the optical fiber cable 70 to enable processing via control system 66, e.g. to enable determination of a difference map indicating the presence and level of contamination in the motor oil. Continued monitoring of the differences in the colorimetric array can be used to monitor progression of the contaminant within the electric submersible pumping system 30.

Figure 6:
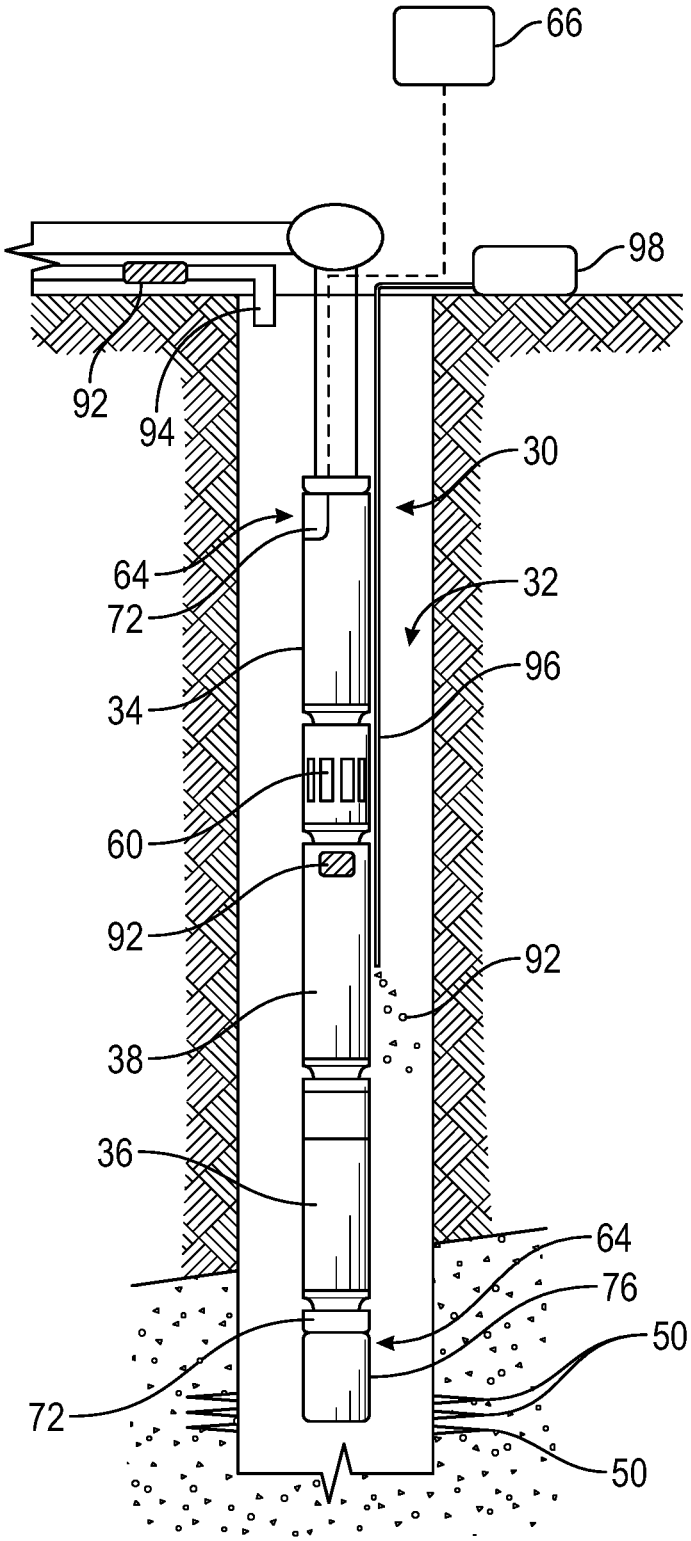
FIG. 6 is an illustration of another example of an electric submersible pumping installation combined with a sensor system, according to an embodiment of the disclosure.

Referring generally to FIG. 6, another embodiment of sensor system 64 is illustrated. In this example, the sensor system 64 works in cooperation with a marker or markers 92. The marker 92 it is used in cooperation with a sensor or sensors 72 of the sensor system 64. By way of example, sensor 72 may comprise a probe or other type of sensor located in base gauge 76. However, additional or other sensors 72 may be located in other components of the submersible pumping system 30 as illustrated.

In some embodiments the gauge 76 may include electronics for receiving, processing, and/or transmitting sensor data. However, the surface control system 66 may be used for processing data or may work in cooperation with gauge 76 to facilitate processing of sensor data indicative of the presence of the marker 92 and thus contaminants.

Depending on the application, the marker or markers 92 may comprise chemical markers, optical markers, nuclear markers, or other types of markers. The sensors 72 are chosen/constructed to detect the presence of such marker which is indicative of the presence of contaminants in, for example, the internal motor oil. In some embodiments, the gauge 76 may be used to gather this data and to correlate it with well fluid entry progression. Various combinations of markers 92 and sensors 72 may be used depending on the physics of interest.

In some applications, the well fluid may already contain a marker or markers 92 which can be exploited by the corresponding sensor or sensors 72 that are able to detect the marker 92 (and thus the unwanted presence of well fluid). The marker 92 may be a chemical substance which dissolves in and/or is suspended in the well fluid. An appropriate chemical sensor 72 can then be used to detect the specific chemical. Chemical sensors designed for specific fluids (without the use of a marker) also may be selected based on known chemistries to detect particular substances or properties, e.g. pH value.

The marker 92 also may be a nuclear marker. Radioactive markers 92 create a higher or lower detection rate depending on their relative position with respect to the detecting sensor 72. The marker 92 also may be an optical marker. For example, marker particles of specific size, shape, material, and/or finish may be used and the detecting sensor 72 may be constructed to detect such particles. Such detecting sensor 72 may be a line-of-site sensor able to detect such particles by laser, ultrasound, or other suitable technique.

The marker 92 also may comprise a viscosity marker. Viscosity marker particles can be used to affect the viscosity of the well fluid, and a corresponding viscosity sensor 72 may be used to monitor for such change. The marker 92 also may comprise a dielectric marker which changes the insulating properties of motor oil within the submersible motor 36. Detection of the change in insulating property via the corresponding sensor 72 provides an indication of the ingress of well fluids.

Additionally, the marker 92 may be a reactive marker. A reactive marker can remain chemically stable when in the original fluid, e.g. within well fluids or internal motor oil. However, the reactive marker undergoes chemical reactions when in contact with an alternate fluid, e.g. internal motor oil or well fluid. Corresponding sensors 72 are able to deduct such reaction. These types of markers also may comprise reactants which serve as enablers and/or catalysts for such chemical reaction. Accordingly, various types of markers may be used individually or in combination to enable detection and monitoring of undesirable constituents, e.g. well fluid in the submersible motor 36.

Referring again to FIG. 6, the marker 92 may be present along the exterior of the electric submersible pumping system 30, e.g. outside a topmost shaft seal of the motor protector 38. Detection of the marker 92 inside the electric submersible pumping system 30 implies fluid ingress. The sensors 72 which detect and indicate unwanted fluid ingress also may be located inside the electric submersible pumping system 30.

In some embodiments, the marker 92 may be deposited into wellbore 32 via a surface line 94. For example, the marker 92 may be deposited down through the casing 48 from a surface level. The marker 92 also may be delivered downhole through an injection line 96 from a surface supply 98. The injection line 96 may be in the form of a tube, e.g. capillary, which delivers the marker 92 to a desired downhole depth. Additionally, the marker 92 may be disposed within the electric submersible pumping system 30 in some embodiments.

In the example illustrated, another marker 92 is illustrated as disposed within the motor protector 38. However, the marker 92 may be delivered via a marker assembly located internally or externally of the submersible pumping system 30. For example, the marker 92 could be contained within a marker assembly located on an external side of the motor protector 38, e.g. at a position outside the first shaft seal of the motor protector 38. In some applications, the marker 92 may be located above or below the submersible pumping system and within or along other components of the overall well completion, e.g. along an upper completion or a lower completion.

The markers 92 also may be used in various combinations and at various locations. In some applications, the marker 92 may be dissolved in the internal motor oil at a predetermined concentration. This type of marker 92 also can be added into the submersible motor 36 or other components of submersible pumping system 30 via a tubing line from the surface or via a repository located within or proximate the submersible pumping system 30.

Similarly, the sensor(s) 72 of sensor system 64 may be positioned at a variety of locations. Examples of suitable locations include outside the submersible pumping system 30, e.g. above, below, or in the vicinity of the submersible pumping system 30. The sensor 72 also may be located inside the submersible pumping system 30, e.g. below each protector shaft seal; at areas of interest on the compensator chamber (labyrinth, bag, bellows, or other motor protector components); at thrust bearing locations within the motor protector 38 and/or submersible motor 36; and/or at other areas of interest inside the submersible motor 36 (pothead, winding, gauge 76, or other motor related components). In some applications, a single sensor 72 may be located near a last barrier to the well fluid so as to provide a warning the submersible pumping system 30 is nearing the end of its life. Use of a single sensor 72 provides a system with low complexity.

In other embodiments, multiple sensors 72 may be used across internal chambers of the motor protector 38. The multiple sensors 72 may be used to provide a progressing metric with respect to well fluids entry over time to enable better predictions of ultimate failure of the pumping system 30. Multiple sensors 72 also may be used to help diagnose issues with respect to important elements in or above the motor, e.g. thrust bearings 42. Various sensor arrangements may be used to monitor equipment robustness and may be positioned in a variety of single locations or combinations of locations. For example, sensors 72 may be located outside of the submersible pumping system 30 above a topmost protector shaft seal, at housing joints, at flames joints, and/or at power connector joints. Depending on the arrangement, the sensor or sensors 72 may be used to detect the presence of a marker 92, an increasing presence of the marker 92, a decreasing presence of the marker 92, and/or changes in the marker 92.

In some applications, the marker 92 may be a naturally occurring substance, and the sensor or sensors 72 may be selected to monitor for the naturally occurring substance, e.g. a specific chemical. In such an application, the sensor or sensors 72 may comprise fluorescence and/or colorimetric sensors which are able to detect a change in color or glow. As described above, the intensity of the signal from such sensor 72 corresponds to the amount of contamination in the system, e.g. in the motor oil. The fiber optic cable 70 (or other suitable communication line 68) may be used to transmit the signals and corresponding data from the sensor system 64 to the processing system 66. Data from a variety of the types of sensors 72 may be transmitted along suitable communication lines 68 located within the power cable 58 or routed separately from the power cable 58.

As described herein, one or more sensors can be positioned at one or more various locations in, on, and/or along the submersible pumping system 30. In some configurations, one or more sensors 72 are positioned at one or more locations that exhibit(s) early signs of failure of the submersible pumping system 30 or component(s) thereof. The sensor(s) can detect subtle change(s), for example, in material properties and/or environmental conditions, to better evaluate the health and/or condition of the submersible pumping system 30 or component(s) thereof.

In some configurations, the sensor 72 is a carbon based, flexible sensing device. Some conventional sensors include silicon as the primary sensing element. However, silicon is rigid, and the response time and sensitivity of a silicon-based sensor has limitations when real time monitoring is required or desired. In contrast, a carbon based sensor, for example, made of or including a nano-carbon based material, such as carbon nanotubes (CNT), can advantageously have or exhibit, for example, high sensitivity, a fast response time, relative ease of manufacturability, flexibility (e.g., highly and/or easily conformable to curved geometry), and/or low power consumption. CNT may have or exhibit properties such as high electrical conductivity, high thermal conductivity, and excellent mechanical properties. Depending on the synthesis route of the CNT, the CNT can have different chirality (e.g., armchair, zigzag), which contributes to unique semiconducting characteristics and can lead to such high sensitivity and fast response time.

The sensitivity of a sensor is governed by the gauge factor, which can be expressed as:

$$G = \frac{dR}{R} / \frac{dP}{P}$$

where R is the resistance of the sensor and P is the property of interest to be captured by the sensing element. For example, for a flex (strain) sensor, P is the length of the active sensing element. For a temperature sensor, P is the actual temperature. For a humidity sensor, P is the relative humidity in the environment. A higher gauge factor indicates a better and faster response in detecting subtle or minute changes in the environment. Due to an ultrahigh surface area and porosities existing within a CNT network, and an ability to custom tailor surface functionalities using click chemistry, CNT sensors are advantageously able to respond to changes in their sensed environment very rapidly (e.g., within about 10 milliseconds), while also being lightweight and flexible.

For a CNT based flex (strain) sensor, changes in the length or flex of a component, for example of the submersible pumping system 30, can be captured by the sensor through monitoring the change in resistivity of the nanotubes. The resistivity of the nanotubes is dependent on the orientation, interface among individual nanotubes, and interaction of nanotubes with a polymer binder or matrix in which the nanotubes are dispersed. For a CNT based humidity sensor, the humidity dependence of the resistance is related to the interaction of the CNT surface with water molecules, which leads to protonation and therefore to an increase in the density of charge carriers. The resistance can also depend on the thickness of the sensor (i.e., the CNT coating thickness, which depends on the manufacturing technique of the sensor) due to the interaction with and diffusion rate of moisture.

CNT based sensor(s) can be used in a sensor system 64 (e.g., as sensor(s) 72) as described herein or according to the present disclosure. CNT based sensor(s) can also or alternatively be used independently or in other sensor systems. One or more CNT based sensor(s) can be positioned in various locations in, on, or along an ESP string.

For example, one or more CNT based sensor(s), for example, configured as downhole flex sensor(s), can be used in critical component structural health monitoring. An ESP system typically includes many different materials, such as various metals, ceramics, and/or elastomers or rubbers. During downhole operation, the ESP system components heat up and deform cohesively to work as a single system, although metal parts often bear most of the weight of the system, while elastomer parts typically offer more flexibility to act as seals or pressure compensation bellows, etc. In normal operations, the components operate within their design limits. However, if the system operates beyond its design limits and migrates toward excessive load and/or stress, for example, due to high heat, aggressive downhole chemicals, etc., the material(s) may exhibit excessive strain and/or flex. Depending on the criticality of the component in the system, a system failure can occur.

Such drifts away from the materials' equilibrium state(s) are subtle and may not be easily detectable or detectable at all via conventional means. To detect these events and make informed decisions about the health and condition of the system, the sensor must be in close proximity to the area most likely to deviate first from the rest of the system and/or from normal operating conditions. The sensor must therefore be small and flexible. The sensor must also have ultrahigh sensitivity (gauge factor) to be able to detect subtle and minute events that signal first deviation from normal operation. CNT-based sensors have these unique traits and advantageously allow for early detection of subtle events.

In some configurations, one or more sensor(s), such as one or more CNT-based sensor(s), can be positioned and/or used to monitor the health (e.g., structural health) and/or condition of the protector 38 (e.g., elastomer protector bags for medium to high temperature applications and metal bellows for ultrahigh temperature wells). In use, the protector 38, e.g., the bag(s) or bellows respond to temperature fluctuations downhole and provide pressure compensation during thermal cycling via expansion and contraction of the bags or bellows. The protector 38 or components thereof could fail downhole due to, for example, chemical swell of the elastomer bag at elevated temperatures leading to reduced elastomer strength, or metal bellows surpassing its yield strength of the material. If the protector 38 or components fail, well fluids may enter the motor.

Figure 7B:
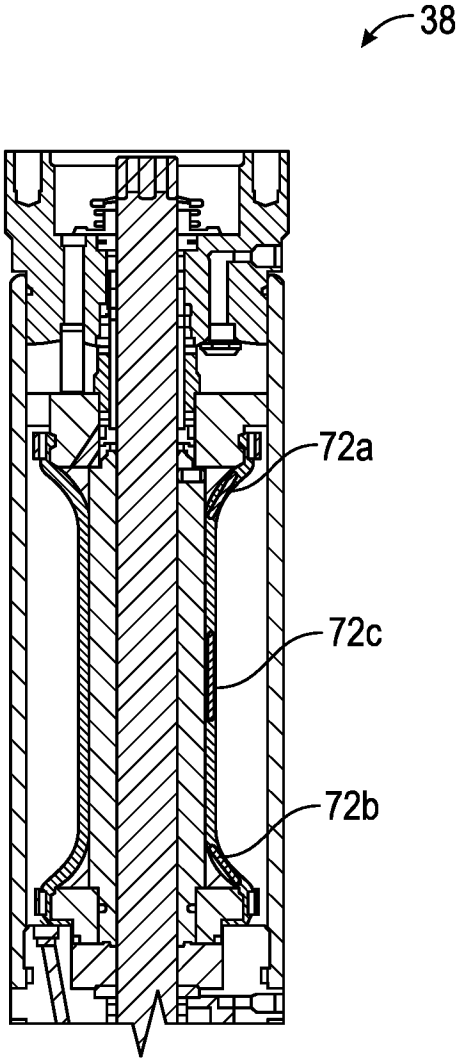
FIG. 7B schematically illustrates the protector of FIG. 7B experiencing contraction during operation.
Figure 7A:
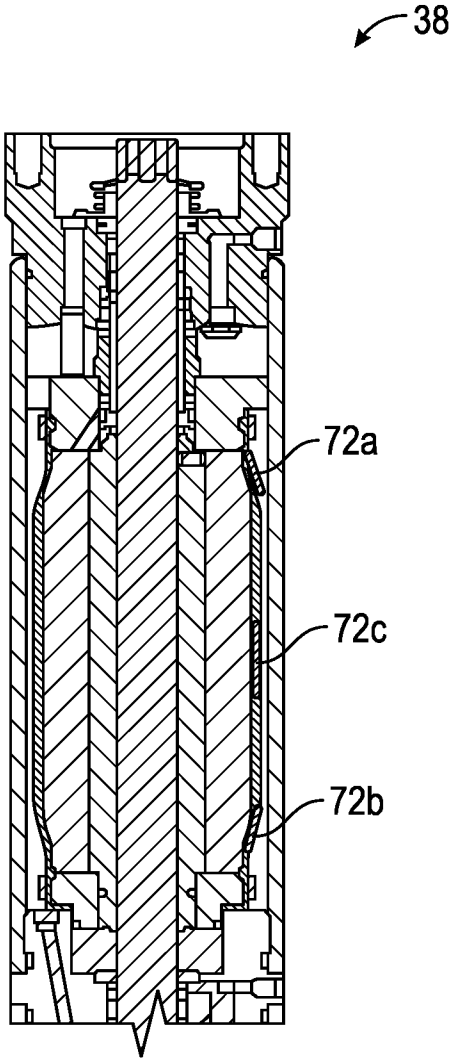
FIG. 7A schematically illustrates carbon nanotube (CNT) based sensors disposed in or on a protector of the electric submersible pumping system, with the protector bag experiencing expansion during operation, according to an embodiment of the disclosure.
Figure 7C:
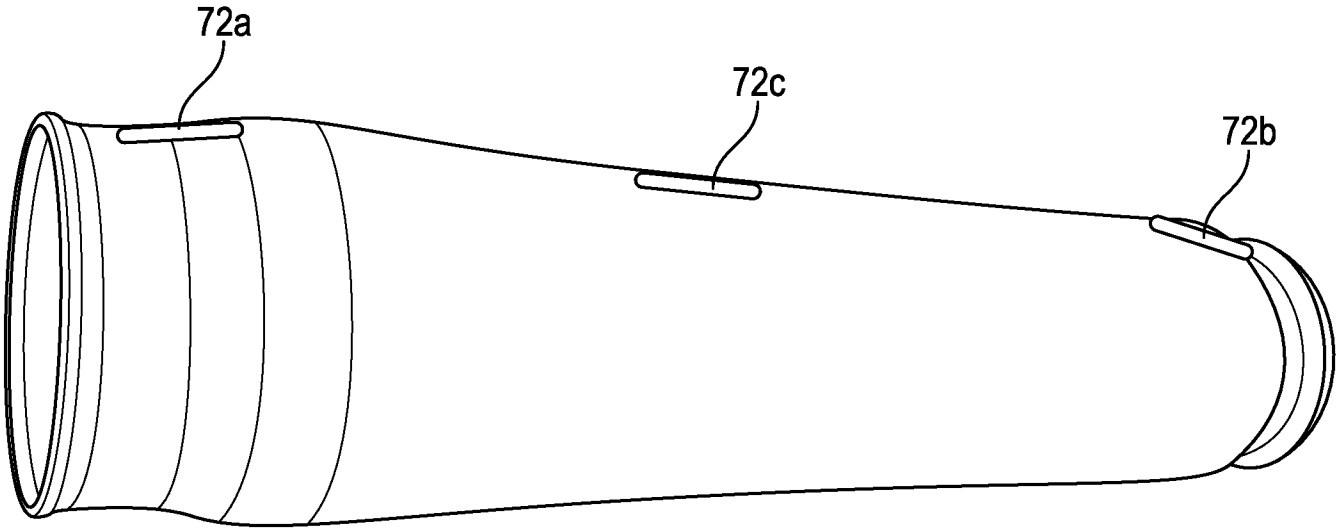
FIG. 7C illustrates the bag of the protector of FIGS. 7A-7B.

One or more sensor(s), for example, CNT-based sensor(s) can be attached to or positioned proximate locations in, on, or along the protector 38, e.g., the protector bag or bellows, to provide accurate monitoring of the motion of the protector bag or bellows in operation. The flexibility of the CNT-based sensor allows the sensor to conform to the surface curvature of the protector bag (e.g., along the shoulder where rupture often initiates) and provide real-time monitoring of the flex motion during thermal expansion and contraction. For example, the example protector 38 bag configuration of FIGS. 7A-7C includes a CNT-based sensor **72*a* positioned at an upper shoulder of the bag, a CNT-based sensor 72*b*** positioned at a lower shoulder of the bag, and a CNT-based sensor 72*c* positioned at the waist of the bag. FIG. 7A illustrates the protector bag experiencing expansion during operation, while FIG. 7B illustrates the protector bag experiencing contraction during operation. The CNT-based sensor(s) can be installed externally to or internally of the protector 38. CNT-based sensor(s) can advantageously detect the effect of chemical swell on the elastomer by detecting small changes in the strain caused by well fluid absorption into the elastomer. The macroscopic expansion and contraction due to temperature variance and microscopic strain variation due to fluid exposure provide valuable information on the overall health condition of the protector bag, and allows for prediction of bag service life in a downhole environment.

As another example, one or more CNT based sensor(s), for example, configured as downhole moisture sensor(s), can be used for moisture and/or humidity detection in the ESP motor 36. Relative humidity is important to the reliability of the ESP motor 36. The air and/or inert gas phase inside the motor 36 chamber is able to take a higher moisture content at elevated temperatures downhole than at ambient temperature (e.g., during installation). Moisture has been a top cause of electrical failure of motor windings because minute moisture tends to hydrolyze the magnet wire insulation typically made from polyimide. Water levels as low as 0.1% in the motor oil can significantly degrade the insulation material in a downhole environment (at downhole pressure and temperature) and lead to a motor short and possible eventual failure. Portions of magnet wires immersed in a water/oil mixture show about the same level of degradation as portions of the magnet wires directly exposed to the inert gas phase, indicating that humidity in the gas phase reacts with and degrades the polyimide insulation as well.

Figure 8A:
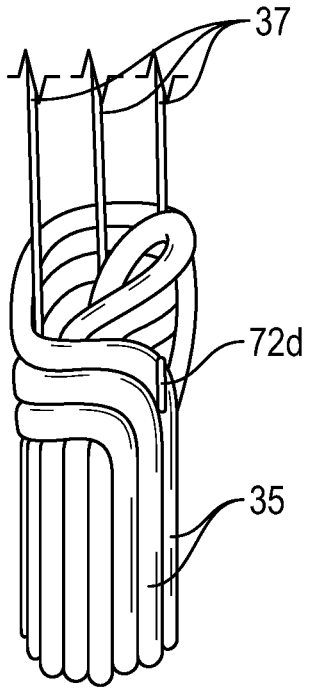
FIG. 8A schematically illustrates an example embodiment of an ESP motor including a CNT-based sensor proximate the head end coil retention.
Figure 8B:
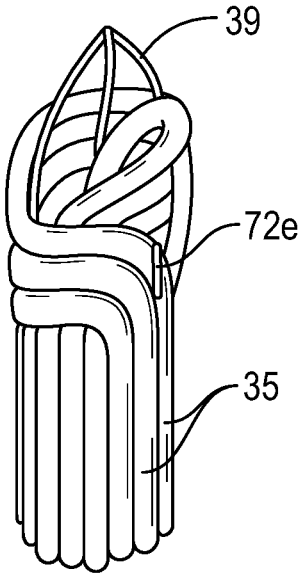
FIG. 8B schematically illustrates an example embodiment of an ESP motor including a CNT-based sensor proximate the base end coil retention.

One or more CNT-based sensor(s) can be deployed or positioned inside the motor 36 to provide real time relative humidity monitoring at downhole pressure and temperature. For example, a CNT-based sensor 72*d*, 72*d* can be positioned on or along the head end coil retention and/or base end coil retention, respectively, of the motor 36, for example as shown in FIGS. 8A-8B. FIG. 8A shows splices of slotliner wrapped magnet wires 35 to brush wires 37. FIG. 8B shows splices of the slotliner wrapped magnet wires 35 to a Y-point 39. The sensor(s) can detect subtle changes in relative humidity that are indicative of change in moisture during the lifecycle of the motor 36. Fluctuations in moisture content can provide insight into the threshold humidity that would lead to initiation of hydrolysis of the polyimide backbone structure and advantageously allow for prediction of realistic service life.

CNT-based sensors can be powered by surface electronics using DC input at a low voltage. Signals from CNT-based sensors can be transmitted to the surface, e.g., for interpretation, along the ESP power cable. In some configurations, CNT-based sensors can be encapsulated within a corrosion resistant, thermally stable housing or casing to reduce chemical attack upon exposure to well fluid, and/or to minimize disturbance(s) from vibration and/or motor oil during operation of the ESP.

Figure 9:
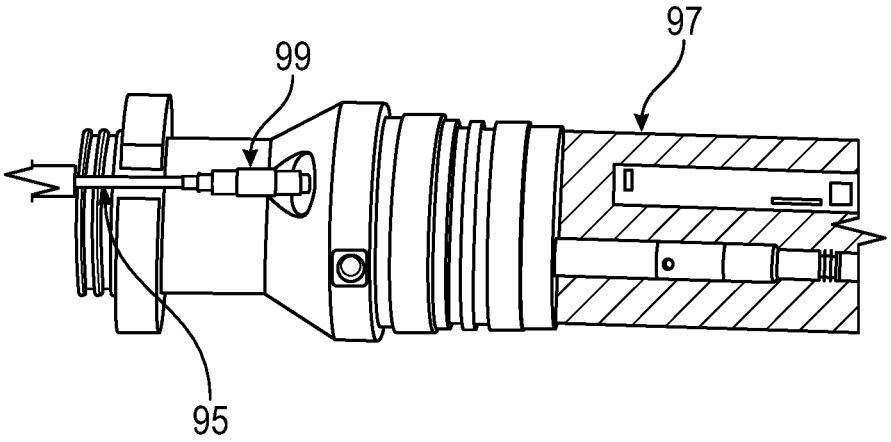
FIG. 9 illustrates leads of a CNT-based sensor encapsulated into a twisted cable that connects to a gauge assembly of an ESP system for power and telemetry.

In some configurations, a dedicated twisted cable 95 is coupled to the CNT-based sensor to transmit power and/or telemetry signals to provide improved signal reliability, for example as shown in FIG. 9. Leads from the sensor 72, for example, from an electronic chassis 97 of the sensor 72, can be connected to the cable 95 via a connected 99. In use, an analog signal generated by the sensor 72 is converted to digital output via an analog to digital converter or a flexible onboard microcontroller for signal processing at the surface. The digital output can be converted and calibrated into a finite reading to indicate, for example, the degree of flexing during operation of the protector 38 or amount of moisture in the motor 36. The signal can be filtered with noise cancellation software, for example, at the surface, to ensure a high signal to noise ratio for better interpretation of the data, allowing for higher sensitivity and accuracy.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a borehole, comprising:

an electric submersible pumping system having a submersible pump powered by a submersible motor coupled with a motor protector;

a power cable coupled to the submersible motor;

at least one colorimetric sensor comprising a colorimetric array having a given pattern of colors disposed within the electric submersible pumping system to detect a substance indicative of well fluid entering an interior of the submersible motor;

a control system for processing data from the at least one colorimetric sensor; and a communication line connecting the at least one colorimetric sensor with the control system.

2. The system as recited in claim 1, wherein the at least one colorimetric sensor comprises a fluorescence sensor.

3. The system as recited in claim 1, wherein an intensity of a signal transmitted by the communication line corresponds to an amount of contamination of the substance indicative of well fluid entering the interior of the submersible motor detected by the at least one colorimetric sensor.

4. The system as recited in claim 1, further comprising a marker, the at least one colorimetric sensor being positioned to detect the marker upon ingress of well fluid into the submersible motor.

5. The system as recited in claim 4, wherein the at least one colorimetric sensor comprises a plurality of sensors located internally and externally of the electric submersible pumping system.

6. The system as recited in claim 1, wherein the communication line comprises an optical fiber cable.

7. The system as recited in claim 1, wherein the communication line is disposed within the power cable.

8. The system as recited in claim 1, further comprising a gauge coupled to the submersible motor, the at least one colorimetric sensor being positioned to extend from the gauge into the submersible motor.

9. A method, comprising:

providing an electric submersible pumping system having a submersible pump powered by a submersible motor coupled with a motor protector;

operating the electric submersible pumping system downhole in a wellbore to pump a well fluid;

utilizing at least one downhole colorimetric sensor to detect a constituent indicative of contamination entering the submersible motor; and providing data from the at least one downhole colorimetric sensor to a control system located at a surface location to enable analysis of future actions with respect to operation of the electric submersible pumping system.

10. The method as recited in claim 9, wherein utilizing the at least one downhole colorimetric sensor comprises utilizing a plurality of downhole sensors.

11. The method as recited in claim 9, wherein utilizing the at least one downhole colorimetric sensor comprises utilizing a fluorescence sensor.

12. The method as recited in claim 9, wherein an intensity of the data corresponds to an amount of the contamination detected by the at least one downhole colorimetric sensor.

13. The method as recited in claim 9, further comprising deploying a marker into the well fluid, where utilizing the at least one downhole colorimetric sensor comprises detecting the marker.

14. The method as recited in claim 9, wherein providing data comprises providing data along a fiber optic cable positioned within a power cable.

* * * * *